United States Patent [19]

Hagberg

[11] Patent Number: 4,596,358

[45] Date of Patent: Jun. 24, 1986

[54] SERVING DEVICE

[76] Inventor: Bruce E. Hagberg, 670 Weston La., Plymouth, Minn. 55447

[21] Appl. No.: 133,236

[22] Filed: Mar. 24, 1980

[51] Int. Cl.[4] ..... B65D 91/00

[52] U.S. Cl. ..... 232/43.1

[58] Field of Search ..... 232/43.1–43.4, 232/44, 24, 25, 23, 45; 49/356, 357; 109/19

[56] References Cited

U.S. PATENT DOCUMENTS

| | | | |
|---|---|---|---|
| 867,165 | 9/1907 | Shultz | 49/356 X |
| 1,359,742 | 11/1920 | Quinn | 232/43.3 X |
| 1,469,359 | 10/1923 | Craw | 232/43.3 X |
| 1,576,656 | 3/1926 | Honsinger | 109/19 |
| 2,034,916 | 3/1936 | Majors | 232/43.4 X |
| 2,663,587 | 12/1953 | Woodhams | 49/356 |
| 4,135,658 | 1/1979 | Hagberg | 232/43.1 |

*Primary Examiner*—Francis K. Zugel

*Attorney, Agent, or Firm*—Peterson, Wicks, Nemer & Kamrath

[57] ABSTRACT

A device for serving merchandise located in the interior of a building to a person located outside of the building is disclosed including first and second frames mounted in an aperture of the building and extending into the interior of the building. A drawer is slidably mounted in the first frame from a first, open position extending out of the first frame to the exterior of the building and to a second, closed position located within the first frame. A first door is pivotally mounted to the top of the first frame for closing the exterior open end of the first frame for movement from a first, horizontal position to a second, closed, vertical position substantially flush with the exterior of the building. The first door is pivoted from its second position to its first position by moving the drawer from its second position to its first position. A second door is pivotally mounted to the top of the second frame for closing the exterior open end of the second frame. A slidable member pivotally attached to the second door and extending through the interior of the second frame allows the second door to be opened and closed from the interior of the building. Thus, the first door in its first horizontal position is in a merchandise receiving position for receiving relatively flat merchandise passed through the second frame, and the serving device is substantially flush with the exterior of the building between customers and when not in use.

12 Claims, 4 Drawing Figures

SERVING DEVICE

BACKGROUND

The present invention relates generally to devices for serving merchandise, particularly to devices for serving flat merchandise, more particularly to devices for serving food, specifically to devices for serving food to customers at a fast food type drive-up serving area, and more specifically to devices for serving pizza to customers at a fast food type drive-up serving area.

With the increasing popularity of fast food type restaurants, drive-up serving areas allowing customers to order and receive their orders from their motor vehicles without entering the restaurant have been gaining popularity and use, especially among elderly, handicapped, or persons picking up orders for many. A need has arisen for devices for serving merchandise that minimizes the energy loss, is secure against break-in, is easily installed, easy to manufacture, and is of hygienic design.

Specifically, prior to the present invention, sliding glass windows were used at some drive-up serving areas for serving food at fast food restaurants. Large amounts of air circulation occurred between the interior and exterior of the building when the glass windows were opened, especially when the cooking and serving areas of fast-food type restaurants are subjected to negative ventilation, i.e., are subjected to lower air pressure than the remaining portions of the restaurant and the outside ambient atmosphere. This air circulation caused heat or air conditioning loss from the interior of the building resulting in waste of energy as well as increased expenses. Further, persons in the interior of the building servicing the drive-up windows were subjected to drastic temperature changes causing greatly increased possibility of illness and reduced efficiency. Sliding glass windows are also very prone to break-in. Furthermore, most sliding glass windows do not open sufficiently to allow a pizza to be handed out without tipping. Tipping the pizza causes the pizza topping to slide to one side and spoil its appearance thus decreasing its salability.

Also, prior serving devices are otherwise unsuitable for serving pizza. Specifically, existing drawers or other serving members of the serving devices for extending the merchandise to the customer are not large enough to accommodate a pizza flat, but it is necessary to curve the ends of the pizza inside the serving member. Making the serving member large enough to accommodate flat pizzas would result in a very bulky member which would be clumsy and take considerable energy to move, but more importantly, would make the serving device too large to fit within the drive-up serving area of most buildings because this area is located in the kitchen where space is at a premium. Further, employees would tend to place other items such as drinks on top of the pizza which would crush the pizza or may result in spilling the drinks or other items on the pizza when the items were being served to the customer.

SUMMARY

Briefly, the present invention provides a device for serving that meets such needs by providing, in the preferred embodiment, a frame arranged to fit within an aperture in the wall. The frame includes a frame passageway and first and second open ends allowing access to the frame passageway from the exterior and the interior of the space, respectively. A door is mounted to the frame for closing the first open end of the frame. The door can be opened and closed from the interior of the space. A shelf is further provided which is movable from a first, merchandise receiving position preferably extending generally horizontally from the exterior of the separating wall to a second, stored position preferably generally flush with the exterior of the separating wall. The shelf can also be moved from its first position to its second position from the interior of the space.

It is thus an object of the present invention to provide a novel device for serving.

It is further an object of the present invention to provide such a novel device for serving food.

It is further an object of the present invention to provide such a novel device for serving which minimizes energy loss.

It is further an object of the present invention to provide such a novel device for serving flat merchandise.

It is further an object of the present invention to provide such a novel device for serving pizza in particular.

It is further an object of the present invention to provide such a novel device for serving including a shelf which is movable to a merchandise receiving position.

These and further objects and advantages of the present invention will become clearer in light of the following detailed description of the illustrative embodiment of this invention described in connection with the drawings.

DESCRIPTION OF THE DRAWINGS

The illustrative embodiment may best be described by reference to the accompanying drawings, where.

Figure 1:
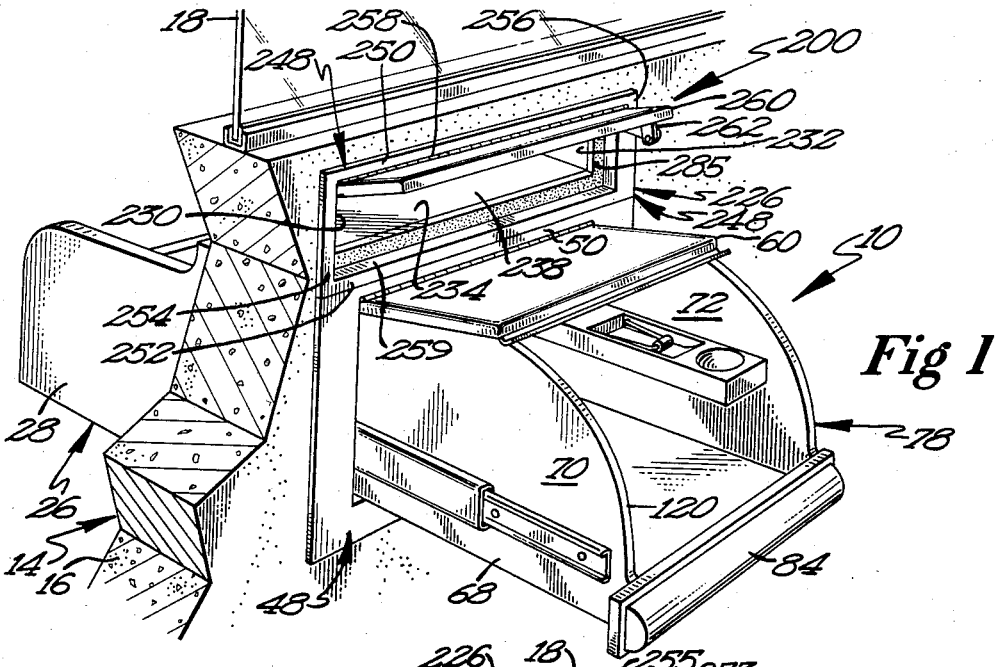
FIG. 1 shows a perspective view of a serving device according to the teachings of the present invention in a building in its first, open position, with portions of the building broken away.

All figures are drawn for ease of explanation of the basic teachings of the present invention only; the extensions of the figures with respect to number, position, relationship, and dimensions of the parts to form preferred embodiment will be explained or will be obvious from the explanation given. Further, the exact dimensions and dimensional proportions to conform to specific force, weight, strength, and similar requirements will likewise be explained or within the skill of the art after the following teachings of the present invention have been read and understood.

Where used in the various figures of the drawings, the same numerals designate the same or similar parts. Furthermore, when the terms "right", "left", "front", "back", "vertical", "horizontal", "first", "second", "top", "bottom", and similar terms are used herein, it should be understood that these terms have reference only to the structure shown in the drawings as it would appear to a person viewing the drawings and are utilized only to facilitate describing the invention.

DESCRIPTION

In the figures, a device generally designated 200, according to the teachings of the present invention, for serving relatively flat merchandise from a space or building, with the merchandise being located in the interior of the space or building, to a person desiring to receive such merchandise and being located outside of the space or building is shown as mounted in an aperture 12 in wall 14. Generally, wall 14 includes a first portion 16, which may be formed of cement block, and a second portion 18, which may be formed of transparent material such as glass, and may include sliding doors or other features, as are well known in the art. Aperture 12 is shown as formed within first portion 16 of wall 14. The building may also include a slab member 20 extending away from wall 14 and which may end in a curb member 22. A roadway 24 allowing motor vehicles to be driven thereon is further shown next to curb member 22.

Device 200, in the preferred embodiment, includes a frame generally designated 226. Frame 226 is comprised of a rectangular portion 228 arranged to fit within aperture 12 in wall 14 and extend into the interior of the building. In particular, rectangular portion 228 defines a frame interior or passageway and includes first and second vertically arranged flat pieces or sides 230 and 232, respectively, a horizontally arranged flat piece or bottom 234, a horizontally arranged flat piece or top 236, a first, outside or exterior open end 238, and a second, inside or interior open end 240. Bottom 234 is interconnected to and between the bottom edges of sides 230 and 232. Top 236 is interconnected to and between the top edges of sides 230 and 232. In the preferred embodiment, sides 230 and 232, bottom 234, and top 236 are formed from sheet metal, and in the preferred embodiment, from heavy gauge stainless steel.

Open end 238 is then formed by the first or outside ends of sides 230 and 232, bottom 234, and top 236. Likewise, open end 240 is then formed by the second or inside ends of sides 230 and 232, bottom 234, and top 236. In the preferred embodiment, sides 230 and 232, bottom 234 and top 236 extend the full length of portion 228 and have lengths approximately equal to the thickness of portion 16 of wall 14. First open end 238 allows access to the frame passageway of frame 226 from the exterior of the building by persons desiring to receive the merchandise and located outside the building. Second open end 240 allows access to the passageway of frame 226 from the interior of the building.

Rectangular portion 228 further includes a frame face 248 attached to sides 230 and 232, bottom 234, and top 236 and which extends around the perimeter of aperture 12. In the preferred embodiment, frame face 248 is formed from heavy gauge stainless steel and is contiguous with sides 230 and 232, bottom 234, and top 236. Frame face 248 includes top and bottom horizontally arranged pieces 250 and 252, respectively, which are interconnected at their ends with similar vertically arranged pieces 254 and 256. Pieces 250, 252, 254, and 256 include a first member 251 arranged parallel to the face of portion 16 of wall 14 and located exteriorly of portion 16 of wall 14 for overlapping portion 16 around and about aperture 12 for making frame 226 substantially weather tight within aperture 12. Further, pieces 250, 252, 254, and 256 of frame face 248 include a second member 253 attached perpendicularly to member 251 and extending into the interior of frame 226, and a third member 255 attached perpendicularly to member 253 and extending in a direction parallel to but opposite to that of member 251. Member 255 is attached to the first or outside ends of sides 230 and 232, bottom 234, and top 236. It should then be noted that members 253 and 255 form a stepped portion 259 in each of pieces 250, 252, 254 and 256 for purposes to be described hereinafter.

A door 260 is pivotally mounted to top piece 250 of frame face 248 by hinge 258 and is arranged to close open end 238 of rectangular portion 228. In the preferred embodiment, door 260 is formed from heavy gauge stainless steel and includes insulation in its interior. Door 260 abuts with stepped portion 259 of pieces 250, 252, 254, and 256 of frame face 248 for providing a weather seal therebetween, for providing a door abutment for preventing door 260 from being pivoted beyond its closed position into the interior of frame 226, and for allowing door 260 to be flush with the exterior of portion 16 of wall 14. Foam insulation 285 may be provided between door 260 and stepped portion 259 of frame face 248 for further providing a weather seal therebetween.

Door 260 further includes a tab member 262 which is attached to the inside surface of door 260 and extends into the passageway of frame 226 when door 260 is in its closed position. An elongated member 264 extends through the passageway of frame 226 adjacent side 232 and has a first end pivotally connected to tab member 262 and a second end which is located exteriorly of frame 226 and in the interior of the building. A notch 266 is formed in the elongated member 264 between its first and second ends. A member 268 attached to top 236 of fraxe 226 slidably receives member 264 and interacts with notch 266.

Figure 2:
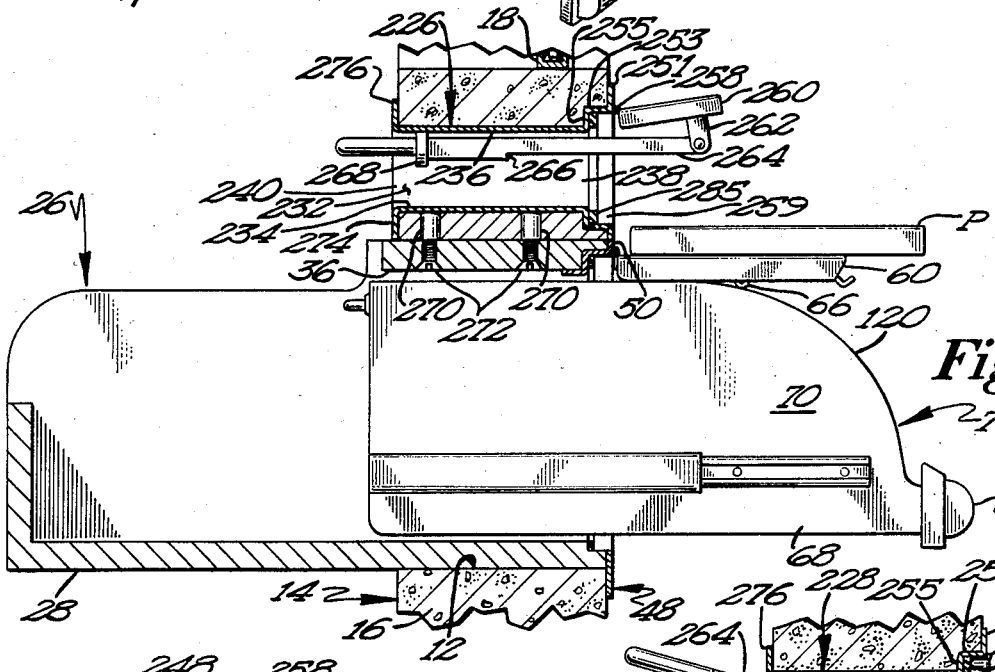
FIG. 2 shows a cross-sectional view of the device of FIG. 1.
Figure 3:
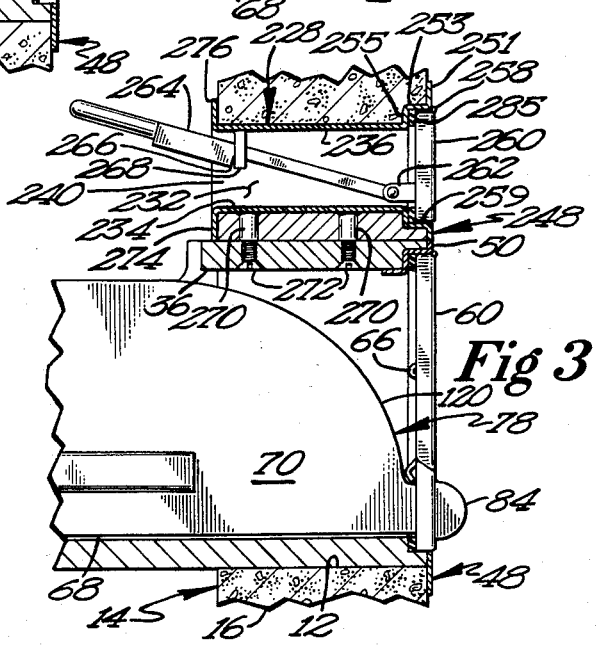
FIG. 3 shows a partial cross-sectional view of the device of FIG. 1, except in its second, closed position.

Thus, door 260 can be opened by a person inside the building by raising member 264 within member 268 such that member 268 does not abut with notch 266. At that time, the person can slide member 264 within member 268 by pushing the second end of member 264 into the frame passageway of rectangular portion 228. Since the first end of member 264 is pivotally connected to door 260 by tab member 262, door 260 pivots on hinge 258 to its open position shown in FIGS. 1 and 2. To close door 260, memter 264 is retracted by pulling the second end of member 264 out of the frame passageway of rectangular portion 228 until notch 266 of member 264 abuts with member 268 as shown in FIG. 3. Notch 266 in an abutting relation with member 268 acts as a lock and prevents opening of door 260 by persons located outside of the building. Thus, device 200 is very secure against break-in.

Device 200 is shown in its preferred form synergistically related to a serving device 10 of the type shown in U.S. Pat. No. 4,135,658 by the same inventor. The disclosure of device 10 including its operation and advantages is incorporated herein by reference to U.S. Pat. No. 4,135,658 issued on Jan. 23, 1979 in the name of Bruce E. Hagberg and entitled "Serving Device". Generally, device 10 includes a frame 26 comprised of a rectangular portion 28 arranged to fit within aperture 12 with device 200. Rectangular portion 28 includes a top 36. Specifically, in the preferred embodiment, rectangular portion 228 of device 200 rests on, is supported by, and is attached to rectangular portion 28, and specifically top 36 of device 10. Rectangular portion 28 further includes a frame face 48 which is contiguous and interacts with frame face 248 of device 200 such that faces 48 and 248 extend around the entire perimeter of aperture 12, with the bottom edge of bottom piece 252 abutting with and being supported by the top edge of top piece 50. Threaded protrusions 270 extend from bottom 234 of frame 226 for receiving screws 272 which extend through top 36 of device 10 for securing frame 226 of device 200 to frame 26 of device 10. A first lip 274 extends generally downward perpendicular from bottom 234 and from the bottom edges of sides 230 and 232 and the second or inside end of bottom 234 for abutting with top 32 of device 10. A second lip 276 is attached to the second or inside ends of sides 230 and 232 and top 236 and parallel to the face of portion 16 of wall 14 for overlapping portion 16 around and about aperture 12 in the interior of the building.

Figure 4:
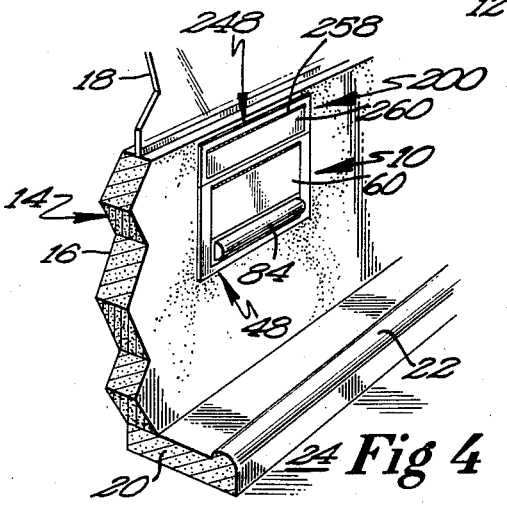
FIG. 4 shows a perspective view of the device of FIG. 1, except in its second, closed position, with portions of the building broken away.

Pivotally mounted to top piece 50 of face 48 is a door 60. Device 10 further includes a drawer 68 movable within the rectangular portion 28 from a first, open position extending out of frame 26 to the exterior of the building shown in FIGS. 1 and 2 to a second, closed position located in the frame interior shown in FIGS. 3 and 4. Camming surfaces 120 are provided on sides 70 and 72 of drawer 68 upon which rollers 66 mounted to door 60 move. Therefore, as drawer 68 moves from its second, closed position as shown in FIGS. 3 and 4 to its first, open position as shown in FIGS. 1 and 2, rollers 66 ride on camming surfaces 120 of sides 70 and 72 of drawer 68 thus raising door 60 from its closed position as shown in FIGS. 3 and 4 to its open, horizontal position as shown in FIGS. 1 and 2. Drawer 68 further includes bumper 84 located adjacent to open end 78 for preventing damage to vehicles when drawer 68 is in its first, open position shown in FIGS. 1 and 2.

Now that devices 10 and 200 according to the preferred embodiment of the present invention have been explained, the selection of various parameters for the optimized devices 10 and 200 for use in serving food can be explained. In the preferred embodiment, the size of aperture 12 is approximately 21.5 inches high and is approximately 22.5 inches wide. In the preferred embodiment, the height of openings 238 and 240 is approximately $3\frac{1}{8}$ inches.

OPERATION

In the operation of device 200 according to the teachings of the present invention with serving device 10 according to the teachings of the present invention, a typical drive-up sale occurs as follows. Specifically, after an order for food has been received, the money is received from the customer in the manner as set forth in the operation of device 10 in U.S. Pat. No. 4,135,658. The operator or person serving the customer can then place the change, beverage, salad, and other non-flat food and merchandise in drawer 68 of serving device 10. Drawer 68 can then be moved to its first, open position such that door 60 is in its open, horizontal position shown in FIGS. 1 and 2 allowing access to the interior of drawer 68 and thus to the merchandise in drawer 68 in the manner as set forth in U.S. Pat. No. 4,135,658.

If the merchandise purchased also includes generally flat merchandise such as pizza P, the serving person then also opens door 260 from its closed position shown in FIGS. 3 and 4 to its open position shown in FIGS. 1 and 2 by moving member 264 as described hereinbefore. At that time, the flat merchandise can be passed through the frame passageway of frame 226 from the interior of the building to the outside of the building. It should then also be noted that door 60 in its open position shown in FIGS. 1 and 2 acts as a shelf such that pizza P can be slid thereon and held for the customer as shown in FIG. 2.

After pizza P has been passed through the passageway of frame 226, door 260 can be moved from its open position shown in FIGS. 1 and 2 to its closed position as shown in FIGS. 3 and 4 by moving member 264 as described hereinbefore. After pizza P has been removed from door 60, drawer 68 can also be moved from its first, open position shown in FIGS. 1 and 2 to its second, closed position shown in FIGS. 3 and 4 such that door 60 is in its second, closed position flush with wall 14 as set forth in U.S. Pat. No. 4,135,658.

It can now be appreciated that device 10 synergistically cooperates with device 200. Specifically, door 60 of device 10 provides a shelf which is movable from a first, merchandise receiving position extending generally horizontally from the exterior of wall 14 to a second, stored position generally flush with the exterior of wall 14. Specifically, door 60 is movable from its first, merchandise receiving position to its second, flush position by moving drawer 68 from the interior of the space or building. Therefore, devices 10 and 200 provide a flush and aesthetically appealing surface when not in use, such as between customers or after hours. This feature is specifically important at drive-in serving areas where customers may drive into any objects or obstructions which project from the building. Although device 200 is utilized with device 10, the movable door or shelf 60 of device 10 can be accomplished by other structure after the teachings of the present invention become known; however, the pivotal door 60 of the present invention is preferred.

It should be noted that devices 10 and 200 substantially prevent heat loss in the Winter and cool air loss in the Summer. Specifically, device 10 prevents air circulation as set forth in U.S. Pat. No. 4,135,658 and device 200 allows minimal air circulation because of its substantially small opening which is only open when flat merchandise which does not fit within drawer 68 is served. Further, due to its small opening size, device 200 is secure against break-in because persons cannot effectively reach therethrough. However, device 200 can allow pizzas having widths of over 20 inches wide to pass therethrough.

Thus, since the invention disclosed herein may be embodied in other specific forms without departing from the spirit or the general characteristics thereof, some of which forms have been indicated, the embodiments described herein are to be considered in all respects illustrative and not restrictive. The scope of the invention is indicated by the appended claims, rather than by the foregoing description, and all changes which come within the meaning and range of equivalency of the claims are intended to be embraced therein.

What is claimed is:

1. Device for serving merchandise from a space having a separating wall, with the merchandise being located in the interior of the space and the person desiring to receive the merchandise being located outside of the space, with the wall including an aperture, comprising, in combination: a first frame arranged to fit within the aperture of the wall and extend into the interior of the space, with the first frame defining a frame interior and including a first open end and including first means for allowing access to the frame interior from the interior of the space; a first door having an interior surface and an exterior surface, with the door being pivotally mounted to the frame from a first, horizontal position extending into the exterior of the space away from the separting wall with the exterior surface in an upward position to a second position closing the first open end of the first frame with the interior surface exposed to the interior of the frame and with the exterior surface exposed to the exterior of the space; and drawer including an access opening and an open end; second means for movably mounting the drawer within the frame interior of the first frame from a first, open position extending out of the first frame to the exterior of the space to a second, closed position located within the frame interior of the first frame, with the drawer including a camming surface, with the first door being movable upon the camming surface of the drawer from its second position to its first, horizontal position as the drawer moves from its second, closed position to its first, open position; a second frame arranged to fit within the aperture of the wall above and with the first frame, with the second frame including a frame passageway, a first open end allowing access to the frame passageway from the exterior of the space, and a second open end allowing access to the frame passageway from the inerior of the space; and second door pivotally mounted to the second frame for closing the first open end of the second frame; and means for opening and closing the second door from the interior of the space allowing merchandise to be passed through the frame passageway of the second frame and on to the exterior surface of the first door in its first, horizontal position and wherien the serving device is substantially flush with the exterior of the spearating wall when the drawer is located in its second, cloased position and the second door closes the first open end of the second frame.

2. The device of claim 1 wherein the drawer includes a bumper adjacent to the open end of the drawer for preventing damage when the drawer is in its first, open position.

3. Device for serving relatively flat merchandise from a space having a separating wall, with the merchandise being located in the interior of the space and the person desiring to receive the merchandise being located outside of the space, with the wall including an aperture, comprising, in combination: a first frame arranged to fit within the aperture of the wall, with the first frame including a frame passageway, a first open end allowing access to the frame passageway from the exterior of the space, and a second open end allowing access to the frame passageway from the inerior of the space; and first door closing the first open end of the first frame; means for opening and closing the first door from the interior of the space; a shelf having an interor surface and an exterior surface, with the shelf being movable from a first, merchandise receiving position extending generally horizontally from the exterior of the separating wall with the exterior surface in an upward position to a second, stored position with the exterior surface being generally flush with the exterior of the separating wall; and means for moving the shelf from its first position to its second position from the interior of the space allowing the serving device to be flush with the exterior of the separating wall when the first door is int its closed position and the shelf is in its second, stored position and allowing relavitvely flat merchandise to be passed from the interior of the space through the second open end into the frame passageway and through the first open end onto and for receipt and holding for the person on the exterior surface of the shelf in its first, merchandise receiving position and when the first door is in its open position.

4. The device of claim 3 further comprising, in combination: a second frame arranged to fit within the aperture of the wall with and below the first frame, with the second frame defining a frame interior and including a first open end and means for allowing access to the frame interior of the second frame from the interior of the space, with the shelf comprising a second door pivotally mounted to the second frame from a first, horizontal position extending away from the separating wall to a second positon closing the first open end of the second frame, and with the means for moving the shelf comprising, in combination: a drawer including an access opening and an open end, means for movably mounting the drawer within the frame interior of the second frame from a first, open position extending out of the second frame to the exterior of the space to a second, closed position located within the frame interior of the second frame, with the drawer further including a camming surface, with the second door being movable upon the camming surface of the drawer for moving the second door from its second, closed position to its first, horizontal position as the drawer moves from its second, closed position to its first, open position.

5. The device of claim 3 wherein the shelf comprises a door pivotally mounted below the first open end of the first frame, with the second position of the pivotal door being generally vertically flush with the exterior of the separating wall.

6. The device of claim 5 wherein the shelf moving means comprises, in combination: a member slidable relative to the separating wall, with the slidable member including a camming surface for moving the second door from its second position to its first, horizontal position as the member is slid relative to the separating wall.

7. The device of claim 6 wherein the slidable member comprises a drawer movably mounted within a second frame arranged to fit within the aperture of the wall with and below the first frame from a first, open position extending out of the second frame to the exterior of the space to a second, closed position located within the second frame.

8. The device of claim 3 or 4 wherein the means for opening and closing the first door comprises, in combination: a tab member attached to the first door and extending into the frame passageway of the first frame; and an elongated member extending through the passageway of the first frame having a first end pivotally connected to the tab member and a second end located exteriorly of the frame and in the interior of the building such that the door can be opened and closed by pushing and pulling the elongated member.

9. The device of claim 8 further comprising, in combination: means for locking the first door in its closed position comprising, in combination: a notch formed in the elongated member; a member attached to the first frame and extending into the frame passageway for slidably receiving the elongated member, with the notch interacting with the member for slidably receiving the elongated member when the first door is in its closed position.

10. The device of claim 3 wherein the frame includes a frame face arranged to overlap the wall around and about the aperture for making the frame substantially weather tight within the aperture.

11. The device of claim 3 further comprising, in combination: a stepped portion formed in the frame around the first open end, with the first door abutting with the stepped portion of the frame for providing a substantial weather seal therebetween.

12. The device of claim 3 wherein the first door is pivotally mounted to the first frame for pivotal movement from an open to a closed position.

* * * * *